United States Patent [19]
Nauheimer
[11] 4,317,537
[45] Mar. 2, 1982

[54] PARTITION STRUCTURE

[75] Inventor: James F. Nauheimer, Chicago, Ill.

[73] Assignee: Container Corporation of America, Chicago, Ill.

[21] Appl. No.: 218,254

[22] Filed: Dec. 19, 1980

[51] Int. Cl.³ ..... B65D 5/48
[52] U.S. Cl. ..... 229/42
[58] Field of Search ..... 229/15, 42

[56] References Cited

U.S. PATENT DOCUMENTS 3,931,924 1/1976 Gardner et al. ..... 229/42
4,039,117 8/1977 Sieffert ..... 229/42

*Primary Examiner*—Herbert F. Ross
*Attorney, Agent, or Firm*—Richard W. Carpenter; Davis Chin

[57] ABSTRACT

A partition structure consisting of a pair of cells joined along a common wall and formed from a single cut and scored blank is disclosed.

1 Claim, 5 Drawing Figures

PARTITION STRUCTURE

SUMMARY OF THE INVENTION

The invention structure comprehends the formation of a pair of rigid side-by-side walled cells with a common center divider wall integral with end and side walls to form a full perimeter liner within a shipping container. dr

THE DRAWING

DESCRIPTION

Figure 1:
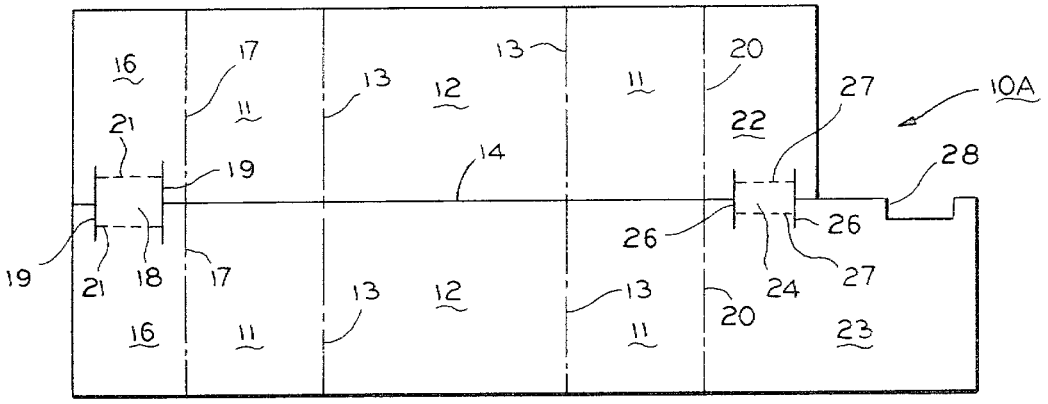
FIG. 1 is a plan view of a cut and scored blank for forming a partition structure according to the invention.
Figure 4:
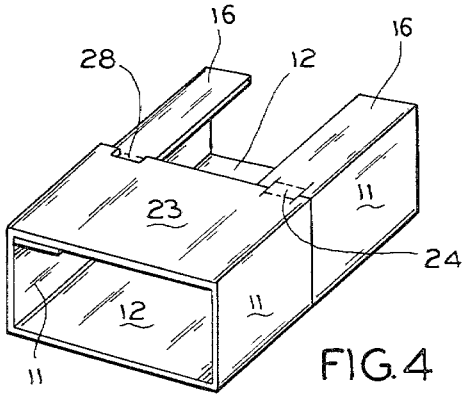
FIGS. 3, 4 and 5 are isometric views showing steps in the forming of the structure of FIG. 2.

The partition structure according to the invention is denoted by reference numeral 10 and is formed from a cut and scored blank 10A of paperboard or the like.

Blank 10A and structure 10 consist of opposed end panels 11 and opposed side panels 12, these being joined by fold lines 13. The end panels 11 and side panels 12 are arranged in mirror relationship with respect to a common cut line 14 therebetween.

One pair of opposed panels 11 are joined at the distal ends thereof by connector panels 16 also arranged in mirror relationship with respect to cut line 14, and foldable with respect to panels 11 along fold line 17. Panels 16 are connected together by a connector tab 18 extending across cut line 14. Tab 18 is defined by spaced short cut lines 19 and spaced short score lines 21 in connector panels 16.

The other pair of opposed panels 11, 11 are also joined at the distal ends thereof by a second pair of connector panels 22 and 23 at fold lines 20, the cut line 14 being therebetween. Panels 22 and 23 are joined across cut line 14 by connector tabs 24 defined by spaced cut lines 26 and spaced short core lines 27 extending between the cut lines 26.

Connector panel 22 has a width less than the width of panel 23, the latter having a width which is equal to the width of a side panel 12.

Panel 23 has a notch 28 therein which falls into register with the connector tab 18 upon assembly of the structure as now described.

Figure 3:
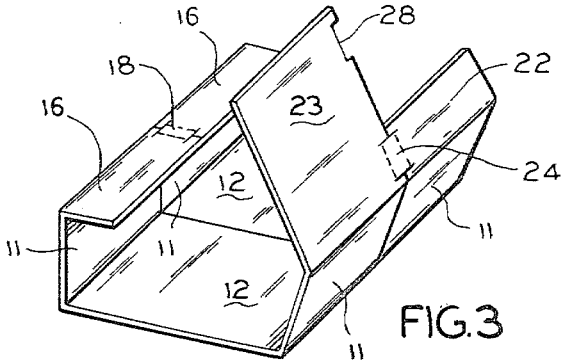
Figure 2:
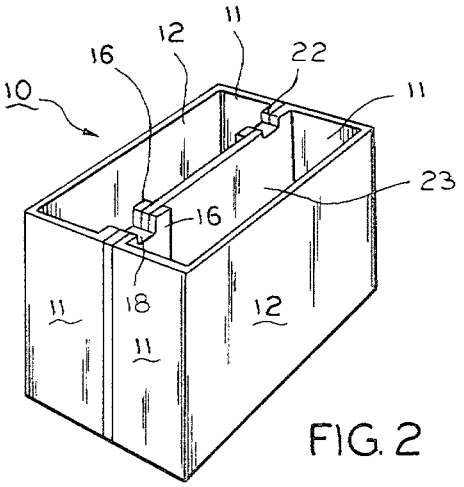
FIG. 2 is an isometric view of the structure formed from the blank of FIG. 1.
Figure 5:
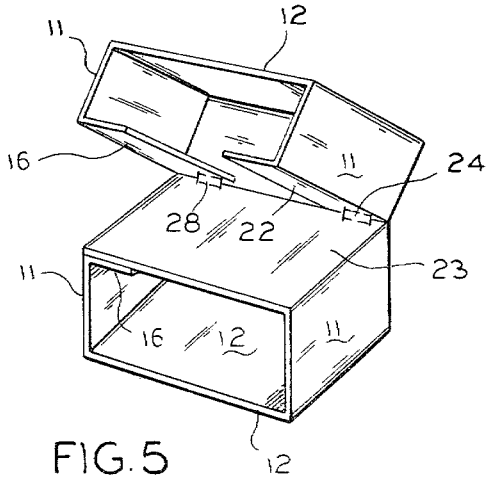

In forming the structure seen in FIG. 2, blank 10A is first formed as seen in FIG. 3, connector panel 23 being folded over one of the confronting connector panels 16, notch 28 of panel 23 falling into register with connector tab 18 between panels 16, it now being folded into position within notch 28 when the other panels 12 and 16 are moved about cut line 14 as seen in FIG. 5. In such final movement connector tab 24 maintains panels 23 and 22 in confronting relationship.

I claim:

1. A partition for dividing a walled container into a pair of rectangular shaped cells, said partition being characterized by a single thickness common wall between the cells and side and end walls connected to each other and to the common wall to form a full perimeter liner within the container, said partition being formed from a cut and scored blank of paperboard or the like comprising:

(a) end and side panels foldably connected to each other and arranged in mirror relationship with respect to like panels by a common cut line;

(b) a first pair of connector panels foldable with respect to the distal ends of a pair of said end panels and connected to each other across said common cut line by a first connector tab;

(c) a second pair of connector panels foldable with respect to the distal ends of the other pair of end panels and connected to each other across said common cut line by a second connector tab;

(d) one of the second pair of connector panels having a width which is less than the width of the other one of the second pair of connector panels and having the same width as said first pair of connector panels;

(e) the width of the other one of the second pairs of connector panels being equal to the width of each of the side panels;

(f) the other one of said second pair of connector panels being of a single thickness and foldable to position between said first pair of connector panels and against said one of said second pair of connector panels so as to form the single thickness only common wall between the cells; and (g) said first and second pair of connector panels being connected across score lines by respective first and second connector tabs, said other one of the second pair being notched to receive said first connector tab, and said second connector tab maintaining said second pair of connector panels in confronting relationship.

* * * * *